US008720368B2

(12) United States Patent
Yamamoto et al.

(10) Patent No.: US 8,720,368 B2
(45) Date of Patent: May 13, 2014

(54) PLATING JIG

(75) Inventors: Wataru Yamamoto, Tokyo (JP); Katsunori Akiyama, Tokyo (JP)

(73) Assignee: Yamamoto-MS Co., Ltd., Tokyo (JP)

( * ) Notice: Subject to any disclaimer, the term of this patent is extended or adjusted under 35 U.S.C. 154(b) by 976 days.

(21) Appl. No.: 12/268,938

(22) Filed: Nov. 11, 2008

(65) Prior Publication Data

US 2009/0120360 A1 May 14, 2009

(30) Foreign Application Priority Data

Nov. 12, 2007 (JP) ..... 2007-292777

(51) Int. Cl.
*B05C 3/00* (2006.01)
*B05C 3/02* (2006.01)
*B05C 13/02* (2006.01)

(52) U.S. Cl.
USPC ..... 118/428; 118/426; 118/429; 118/423; 118/500

(58) Field of Classification Search
USPC ..... 269/57–69; 118/428, 500–506, 423, 118/429, 426; 204/297.01, 297.06, 297.12
See application file for complete search history.

(56) References Cited

U.S. PATENT DOCUMENTS 2,335,462 A * 11/1943 Sommerville ..... 264/136
4,792,245 A * 12/1988 Fuke et al. ..... 384/610
5,011,004 A * 4/1991 D'Amato ..... 198/791
5,580,432 A * 12/1996 Shibata et al. ..... 204/297.1
6,743,297 B2 * 6/2004 Egashira et al. ..... 118/730
7,138,016 B2 * 11/2006 Reardon et al. ..... 118/313

FOREIGN PATENT DOCUMENTS

JP 2002-327291 A 11/2002
JP 2002-339078 A 11/2002

* cited by examiner

*Primary Examiner* — Yewebdar Tadesse
(74) *Attorney, Agent, or Firm* — Crowell & Moring LLP

(57) ABSTRACT

A plating jig can perform the processing of plating wherein a thickness of a plating film formed on each object to be plated becomes even when a plurality of objects to be plated are plated at a time. The plating jig is horizontally disposed, immersed in plating solution, and rotated about a rotational axis. The plating jig includes a plurality of supporting rods and a pair of end plates which support both ends of the supporting rods. The supporting rods are disposed on the circumference of the end plates. A plurality of notches are formed on the supporting rod at regular intervals along the rotational axis.

10 Claims, 7 Drawing Sheets

PRIOR ART

PLATING JIG

CROSS-REFERENCE TO RELATED APPLICATION(S)

This application claims the foreign priority benefit under Title 35, United States Code, §119(V1)-(d), of Japanese Patent Application No. 2007-292777A, filed on Nov. 12, 2007 in the Japan Patent Office, the disclosure of which is herein incorporated by reference in its entirety.

BACKGROUND OF THE INVENTION

1. Field of the Invention

The present invention relates to a plating jig for performing electroless plating applied to a wafer.

2. Description of the Related Art

In recent years, plating technology has extensively been applied to various fields of technologies, such as one which utilizes wiring for semiconductor chips. In the field of semiconductor-related industries, wiring pitches are required to be reduced to accomplish high integration and performance. For example, in a wiring technology employed in latest years, wiring grooves are generated on an oxide film formed on a silicon wafer in a dry etching process. The wiring grooves are plated, wherein a wiring material is embedded.

According to a method of plating such an object to be plated as the wafer and the like, JP2002-327291A discloses an electroplating method, wherein an anode plate is disposed opposite to a surface to be plated of an object to be plated immersed in a plating solution, fresh plating solution is jetted to the surface to be plated, and the surface to be plated is plated by energizing between the surface to be plated and the anode plate.

However, the process of forming a plated layer generally takes some time. The conventional electroplating method is required to conduct a series of operations for each object to be plated, and is not suitable for shortening and streamlining operations for a processing of plating in which a number of objects to be plated are plated.

As shown in FIG. 7, JP2002-339078A discloses an electroless plating jig 110, whereby enabling a surface 121 to be plated of a wafer 120, which is an object to be plated, to be exposedly supported. The plural number of the electroless plating jigs 110 are piled on a top of another, connected, and immersed in plating solution 131 pooled in a plating tank 130 so as to perform electroless plating.

However, the plating solution 131 in the plating tank 130 generates hydrogen in the process of plating. Accordingly, the higher the density of hydrogen becomes, the nearer to the surface of the plating solution the depth of the plating solution becomes in the plating site. Therefore, according to the electroless plating method, in which the conventional plating jig 110 is used, the thicknesses of electroplated films formed on the wafer 120 disposed at a shallow depth and the wafer 120 disposed at a deep depth become inhomogeneous.

The temperature of an upper part of the plating solution 131 becomes higher than that of a lower part of the plating solution 131. Accordingly, the velocity of forming a plated film on the wafer 120 disposed in the upper part of the plating solution 131 is higher than that of forming the plated film on the wafer 120 disposed in the lower part of the plating solution 131. The thicknesses of the plated films formed on the wafers 120 disposed in the upper part and the lower part of the plating solution 131 become inhomogeneous.

BRIEF SUMMARY OF THE INVENTION

An aspect of the present invention provides a plating jig which prevents a plated film formed on each object to be plated from becoming inhomogeneous and allows the plated film to evenly be formed when a plurality of objects to be plated are plated at a time.

The plating jig of the present invention holds an object to be plated, and is immersed in plating solution and rotated about a rotational axis horizontally disposed. The plating jig includes a plurality of supporting rods disposed in parallel with the rotational axis; and a pair of end plates for fixing both ends of the plurality of supporting rods, wherein one supporting rod and the other supporting rods are well-positioned, whereby supporting the object to be plated, and a plurality of notches are formed on the supporting rods at predetermined intervals along the rotational axis.

A rotational axis of the plating jig of the present invention is horizontally disposed. The objects to be plated are rotated in the process of plating. Accordingly, even if a temperature of plating solution and a density of hydrogen differ in depths of the plating solution, the plating jig can prevent a thickness of a plated film formed on a surface to be plated from becoming inhomogeneous. Supporting rods, on which a plurality of notches are formed, can support a plurality of objects to be plated. Accordingly, the plating jig can perform the processing of plating wherein a plurality of objects to be plated are plated at a time, whereby shortening and streamlining the operations for plating.

If the notches formed on the supporting rods of the plating jig are formed in a V-shaped cross section, an abutting surface between the object to be plated and the supporting rod can be reduced, and the plating solution can be smoothly flown on the notches. Therefore, the V-shaped notches are suitable to perform the processing of plating over a wide area.

If a plurality of supporting rods of the plating jig are disposed at regular intervals, stress acting on the objects to be plated is evenly distributed by supporting the objects to be plated in balance. Accordingly, the supporting rods are suitable to prevent the destruction of the objects to be plated.

Further, four supporting rods with respect to the plating jig may as well be disposed.

The plating jig of the prevent invention can perform the processing of plating wherein a thickness of a plating film formed on each object to be plated becomes even when a plurality of objects to be plated are plated at a time.

DETAILED DESCRIPTION OF THE PREFERRED EMBODIMENTS

Figure 1:
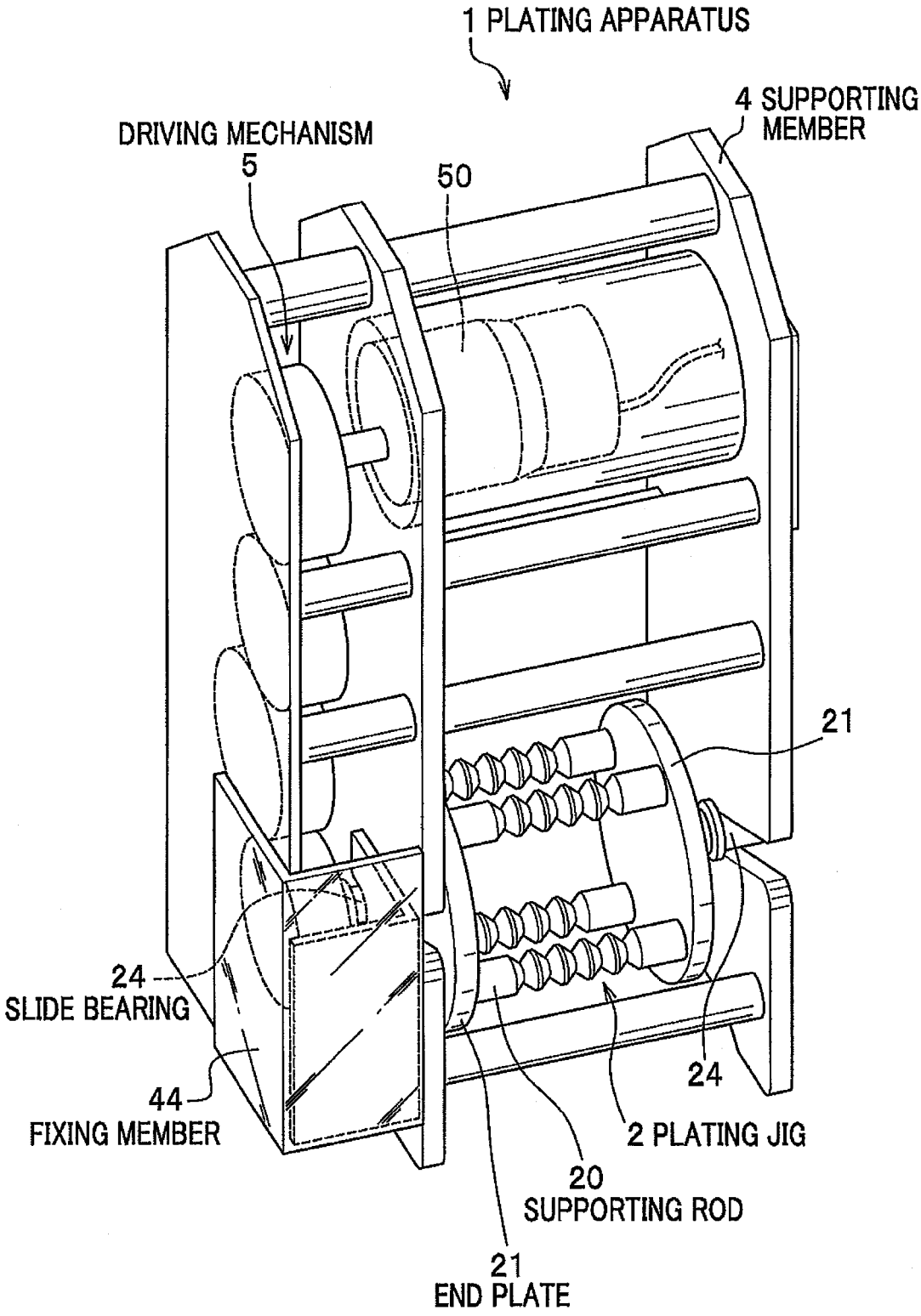
FIG. 1 is a perspective view of a plating apparatus of the preferred embodiment of the present invention.
Figure 2:
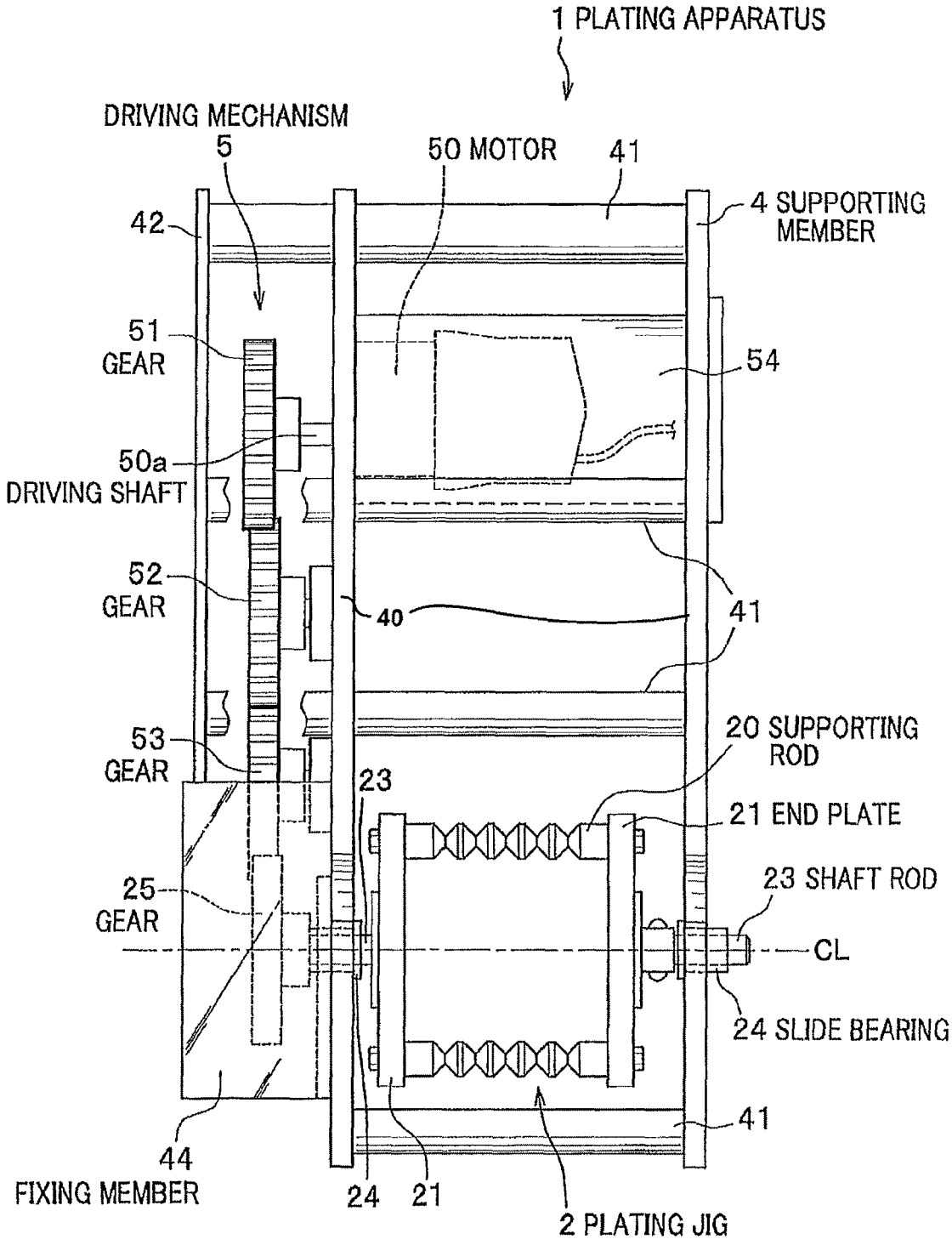
FIG. 2 is a front elevation view of the plating apparatus shown in FIG. 1.
Figure 3:
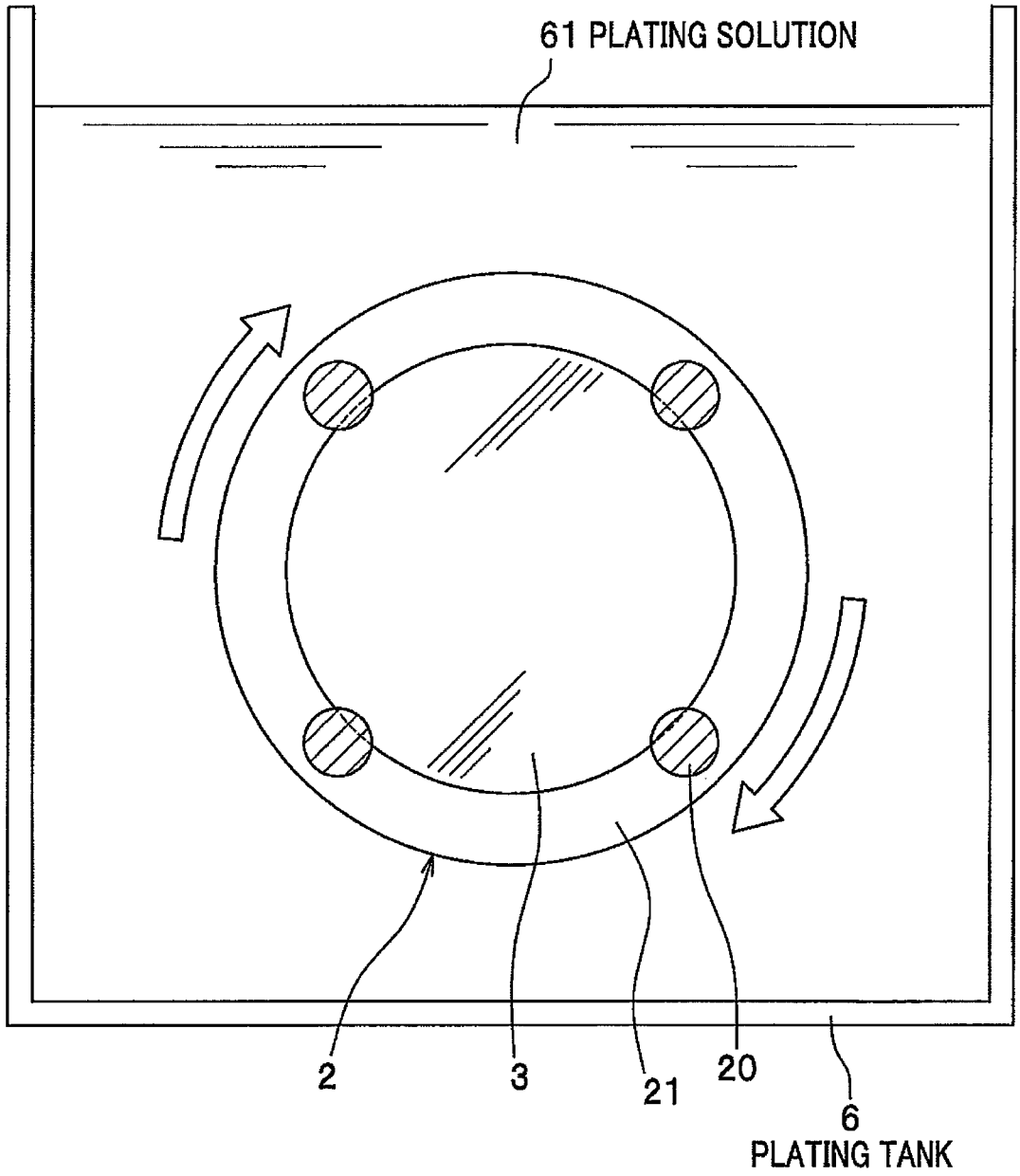
FIG. 3 is a side elevation showing a mechanism of a plating jig shown in FIG. 1.
Figure 4:
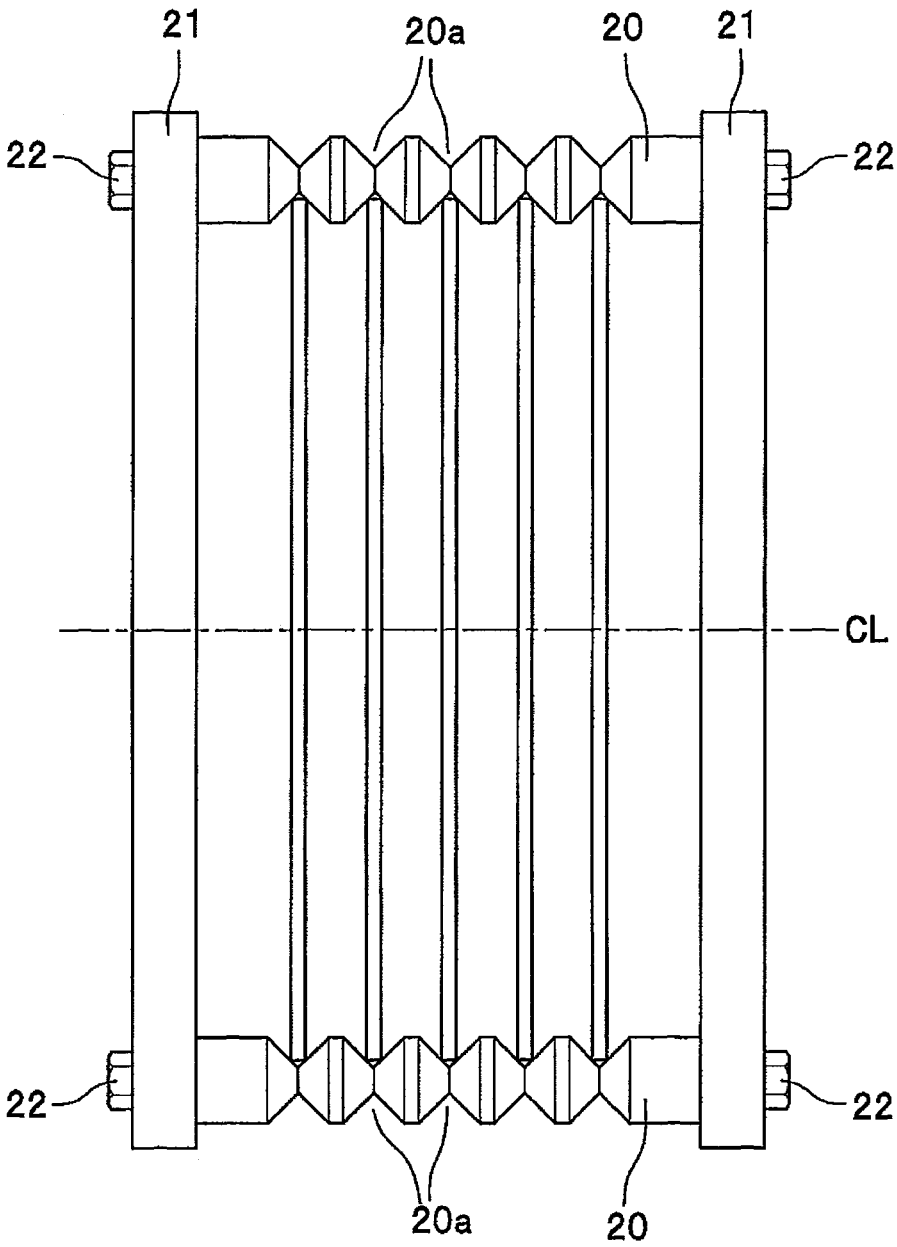
FIG. 4 is a front elevation view of the plating jig shown in FIG. 1.
Figure 5:
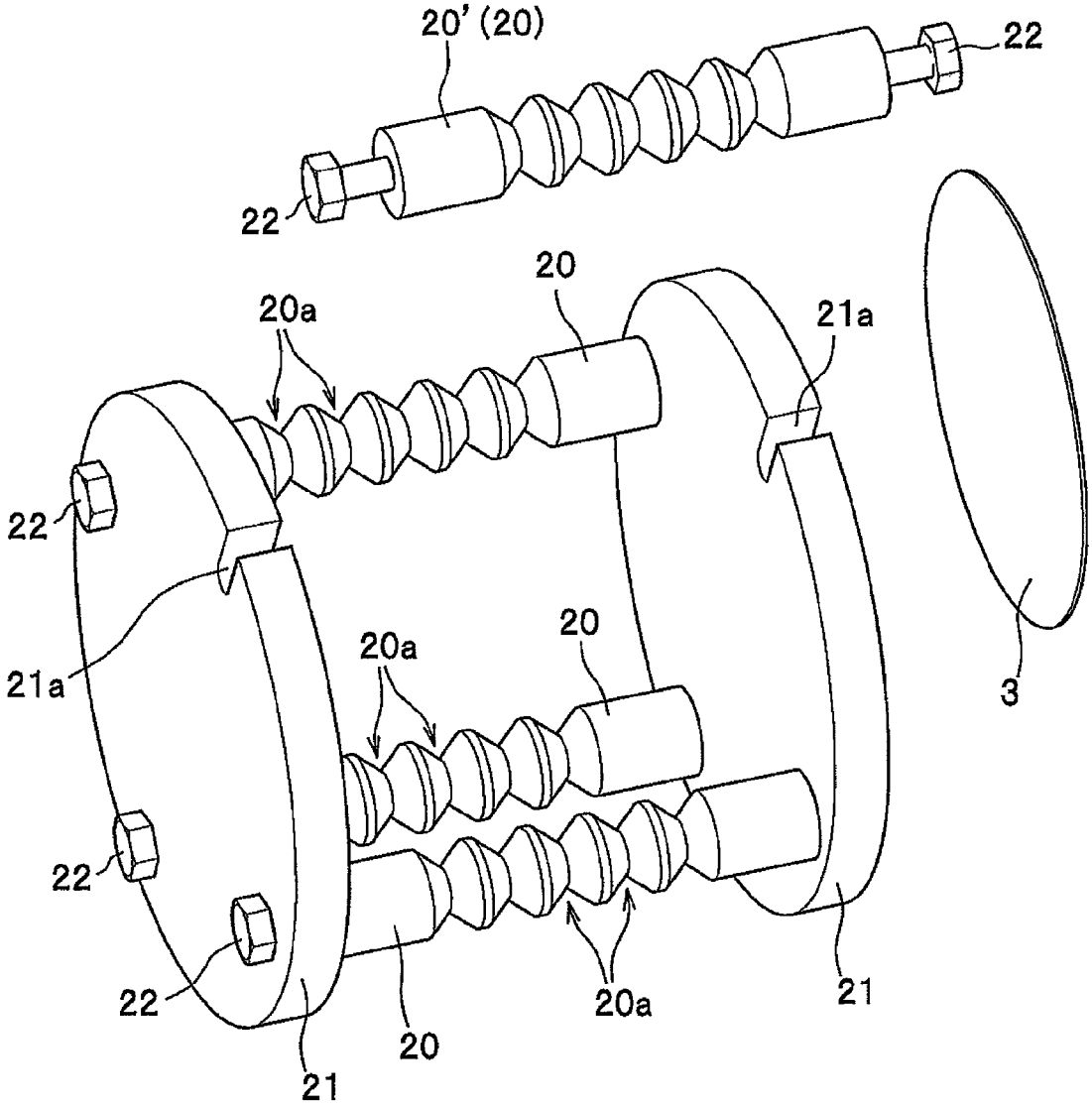
FIG. 5 is an exploded perspective view of explaining a method of attaching an object to be plated to the plating jig shown in FIG. 1.
Figure 6A:
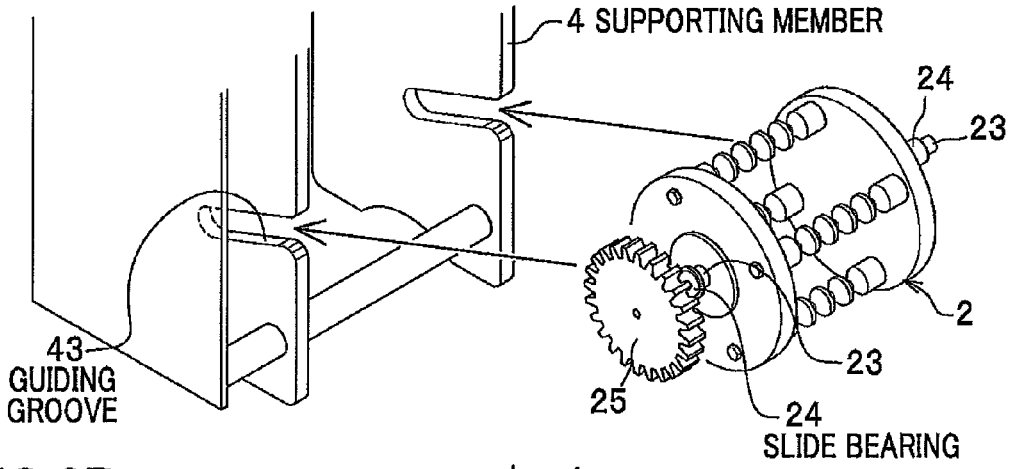
FIGS. 6A, 6B, and 6C are partially perspective views of explaining methods of attaching, fixing, and detaching the plating jig to a supporting member constituting the plating apparatus shown in FIG. 1.
Figure 6B:
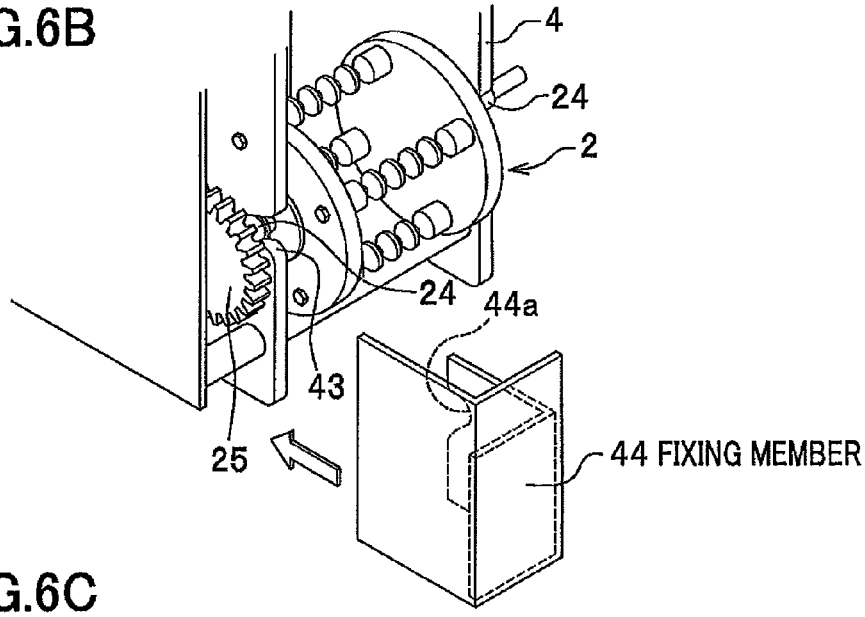
Figure 6C:
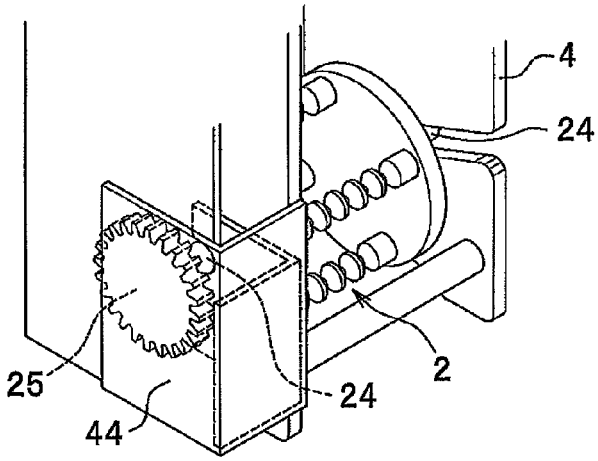
Figure 7:
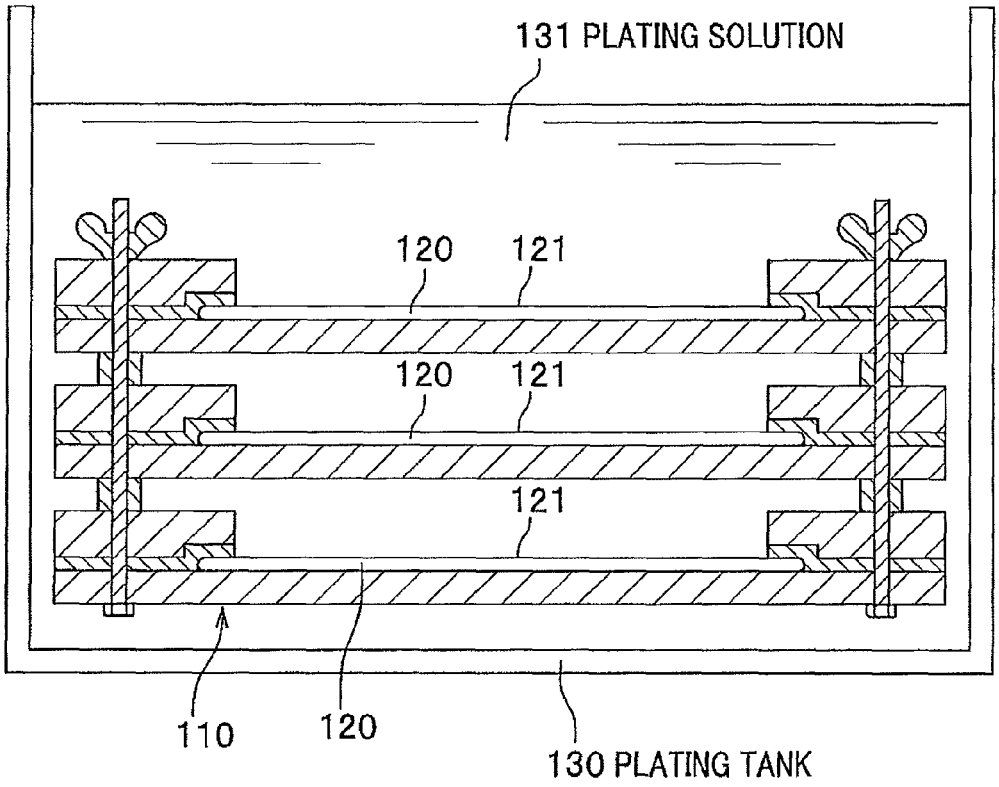
FIG. 7 is a cross sectional view of a plating jig in prior art.

The preferred embodiment of the present invention will be described. FIG. 1 is a perspective view of a plating apparatus of the embodiment of the present invention. FIG. 2 is a front elevation view of the plating apparatus. FIG. 3 is a side elevation showing a mechanism of a plating jig of the embodiment. FIG. 4 is a front elevation view of the plating jig. FIG. 5 is an exploded perspective view of explaining a method of attaching an object to be plated to the plating jig. FIGS. 6A, 6B, and 6C are partially perspective views of explaining methods of attaching, fixing, and detaching the plating jig to a supporting member constituting the plating apparatus of the embodiment.

The plating apparatus 1 of the embodiment plates a silicon wafer 3 (FIGS. 3 and 4), which is an object to be plated. As shown in FIGS. 1 and 2, the plating apparatus 1 includes a plating jig 2 for supporting the object to be plated, a supporting member 4 for rotatably supporting the plating jig 2, and a driving mechanism 5 for giving the plating jig 2 a driving force, whereby rotating the plating jig about the axis of rotation.

As shown in FIG. 3, the plating apparatus 1 is disposed in a plating tank 6 pooling plating solution 61 wherein at least the plating jig 2 is completely immersed under operation. The plating jig 2 holding the silicon wafers 3 is rotated about the horizontal axis of rotation by operating the plating apparatus 1.

As shown in FIGS. 1 and 2, the plating jig 2 is rotatably supported at both ends thereof via slide bearings 24 at a lower portion of the supporting members 4. One end (gear 25) of the plating jig 2 is connected to the drive mechanism 5. A rotary motion of a motor 50 disposed at an upper portion of the supporting members 4 is transmitted to the plating jig 2 via the driving mechanism 5 (gears 51 to 53).

Hereinafter, each part of the plating apparatus 1 will be described in detail.

The plating jig 2 is a member for holding wafers 3, being immersed in the plating solution, and being rotated about the horizontal axis of rotation. The plating jig 2 includes four supporting rods 20 and a pair of end plates 21 which fix both ends of the supporting rod 20. The four supporting rods are in parallel with a rotational axis CL and disposed on the circumferences of the end plates 21 whose center is on the rotational axis CL.

One supporting rod 20 and the other three supporting rods 20 are disposed at a constant interval on the circumference of the end plate 21, whereby supporting the wafers 3. These supporting rods 20 supporting the wafers 3 (FIG. 3) are disposed in such a manner that stress acting on the wafers 3 is evenly distributed. As shown in FIG. 4, each supporting rod 20 is fixed at the ends thereof with the end plates 21 via a bolt 22.

As shown in FIG. 4, five notches 20*a* at a constant interval along the rotational axis CL are formed on each supporting rod 20, whereby securely holding the wafers 3. The five notches 20*a* formed on the supporting rod 20 allow five pieces of wafers 3 to be held at a time.

Each of the five notches 20*a* is formed in a V-shaped cross section, whereby reducing the dimension of contact surface between the wafer 3 and the supporting rod 20, and allowing the plating solution 61 to smoothly flow on the notches 20*a*.

The number of supporting rods 20 disposed on the plating apparatus 2 is not limited. The number of supporting rods 20 can be changed. For example, three or five pieces of supporting rods can be applied.

The supporting rod 20 may as well be extended, whereby holding a greater number of wafers 3. The number of notches 20*a* is not limited, but can be changed as needed. The cross section of the notch 20*a* is not limited to the V-shaped cross section, but can be changed as needed.

As shown in FIG. 4, the end plates 21 are disposed at both ends of the supporting rods, and fix the four supporting rods 20 with the bolts 22.

As shown in FIG. 5, a U-shaped groove 21*a* is formed in the end plate 21 so that one (supporting rod 20') of the four supporting rods 20 is detachably disposed when the wafers 3 are attached and removed. Bolt holes (not shown) are formed in the end plates 21, wherein the other three supporting rods 20 are fixedly disposed.

As shown in FIG. 2, shaft rods 23 are projectingly disposed on the end plates 21 on the rotational axis CL of the plating jig 2. Each shaft rod is rotatably supported by the slide bearings 24 fixed by the supporting member 4. Further, a gear 25 is integrally formed at a tip end of one shaft rod 23 (shaft rod 23 on the left side of FIG. 2), and rotates the plating jig 2 by using the driving force transmitted from the motor 50 via the gears 51, 52, and 53.

As shown in FIGS. 1 and 2, the supporting member 4 is an acrylic resin member constituting a casing of the plating apparatus 1 which supports the plating jig 2 and the driving mechanism 5.

In the embodiment of the present invention, as shown in FIG. 2, the supporting member 4 includes a pair of side plates 40 and side members 41. The side members 41 are laterally disposed between the side plates 40, and connected to the side plates at both ends thereof. A covering member 42 is disposed via the side members 41 on the side of one side plate 40 of the supporting member 4, so that the gears 51, 52, 53, and 25 are covered.

As shown in FIGS. 6A and 6B, a guiding groove 43 is formed in the side plate 40. The guiding groove 43 slidably supports the slide bearing 24 holding the shaft rod 23.

As shown in FIG. 6A, the guiding groove 43 is obliquely formed so that a bottom part is located below an opening part, which prevents the slide bearing 24 of the plating jig 2 from coming off by gravity.

As shown in FIGS. 6A and 6B, the width of the guiding groove 43 is formed in accordance with the outer diameter of the slide bearing 24 so that the width of the guiding groove 43 becomes equal to the outer diameter of the slide bearing 24. The plating jig 2 is removable from the supporting member 4 by slidably supporting the slide bearings 24 holding the shaft rod 23. Accordingly, as the plating jig 2 can easily be detached and reattached, the efficiency of operations such as replacement of the plating jig 2, detachment, and reattachment of the wafer 3 can be improved.

As shown in FIG. 6C, a fixing member 44 is disposed in the supporting member 4 so as not to detach the slide bearings 24 holding the shaft rods 23 from the guiding grooves 43 during operation of the plating apparatus 1 (during operation of the plating jig 2 rotationally driven).

As shown in FIGS. 1 and 6C, during operation of the plating apparatus 1 (during operation of the plating jig 2 rotationally driven), the fixing member 44 prevents the plating jig 2 from detaching from the supporting member 4.

As shown in FIGS. 6B and 6C, the fixing member 4 is an acrylic resin member so as to rotatably hold the shaft rods 23 via the slide bearings 24, so that the supporting member 4 (guiding groove 43) can prevent the shaft rods 23 from coming off during operation of the plating jig rotatably driven. A recessed part 44*a* of the fixing member 44 is formed in accordance with the outer diameter of the slide bearing 24, whereby rotatably holding the slide bearing 24. Accordingly, the recessed part 44*a* prevents the plating jig 2 from coming off the supporting member 4 during operation of the plating apparatus 1 (during operation of the plating jig 2 rotatably driven), which allows a stable operation of plating to be performed.

For example, the fixing member 44 is fixed with the supporting member 4 by screws (not shown) of a PEEK resin (polyether ether ketone) or the like, so that the supporting member 4 can prevent the plating jig 2 from coming off during operation of the plating jig 2 rotatably driven.

In the embodiment of the present invention, the slide bearing 24 holding the shaft rod 23 is slidably supported, and the plating jig 2 is fixed by the fixing member 44. However, if the plating jig 2 is rotatably supported, the shaft rod may as well be slidably supported directly on the guiding groove 43 without using the slide bearing 24. Accordingly, the plating jig 2 may as well be rotatably supported by the supporting member 4. Further, in this case, the shaft rod 23 is rotatably fixed directly by the fixing member 44.

A method of holding the plating jig 2 is not limited, but can be modified. For example, a projected part may as well be formed on the guiding groove 43 as a holding part, whereby holding the slide bearing 24 without using the fixing member 44.

The driving mechanism 5 is constituted by a source of an electric power and a means for transmitting the electric power so as to rotatably drive the plating jig 2. As shown in FIG. 2, the driving mechanism 5 includes a motor 50, a gear 51 attached to a driving shaft 50*a* of the motor 50, a gear 52 engaged with the gear 51, and a gear 53 engaged with the gear 52. The motor 50 is disposed at an upper portion of the supporting member 4. The gears 51, 52, and 53 are disposed at a lateral surface (lateral surface on the left side of FIG. 2) of the supporting member 4.

The motor 50 is disposed inside a covering member 54 fixed with the supporting member 4, which prevents the plating solution 61 from splashing on the motor 50 when the plating apparatus 1 is disposed in the plating tank 6, and when the plating jig 2 is rotatably driven.

The driving mechanism 5 can drive the motor 50, transmit the rotary movement of the driving shaft 50*a* of the motor 50 to the gear 52 via the gear 51, and rotate the gear 52. Then, the driving mechanism 5 can transmit the rotary movement of the gear 52 to the gear 53 via the gear 52, rotate the gear 53, and subsequently rotate the gear 25 engaged with the gear 53. Accordingly, the driving mechanism 5 can rotatably drive the plating jig 2 and the wafers 3 held by the plating jig 2 about the rotational axis CL via the shaft rods 23 connected to the gear 25.

Materials constituting the gears 51, 52, and 53 are not limited, only if the materials have a property of chemical resistance (plating solution resistance). For example, a polymethyl pentene (TPX, registered trademark) resin and a polypropylene resin can be applied for the gears. In the embodiment of the present invention, the rotary movement of the motor 50 is transmitted to the plating jig 2 via the gears 51, 52, 53, and 25. However, the rotary movement of the motor 50 may as well be transmitted to the plating jig 2 via a belt made of the materials having the property of chemical resistance. The transmitting mechanism with respect to the rotary movement of the motor 50 is not limited, if the rotary movement of the motor 50 is securely transmitted to the plating jig 2.

In the embodiment of the present invention, the plating jig 2, the supporting member 4, and the fixing member 44 are formed of the acrylic resin. However, other resins may as well be applied to form these components, only if the resins have the properties of chemical resistance and heat resistance (heat resistance to a high temperature of about 95 degrees), and only if the resins are as hard as the acrylic resin.

Subsequently, the operation of the plating apparatus 1 of the present invention will be described.

As shown in FIGS. 4 and 5, the plating jig 2 holds the wafers 3, which are an object to be plated. The supporting rod 20' is removed from the end plates 21, and the wafers 3 are disposed on the notches of the other three supporting rods 20, and the supporting rod 20' is reattached and fixed. At this time, the wafers 3 are held in such a manner that the center of the wafers corresponds with the rotational axis CL of the plating jig 2.

As shown in FIGS. 6A and 6B, the rotational axis CL of the plating jig 2 is horizontally disposed, and the slide bearings 24 holding the shaft rods 23 of the plating jig 2 are slidably supported on the guiding grooves 43. Accordingly, the plating jig 2 is rotatably supported by the supporting member 4. The gear 25 connecting to the shaft rod 23 of the plating jig 2 is engaged with the gear 53 of the driving mechanism 5. Accordingly, the plating jig 2 is connected to the driving mechanism 5. The fixing member 44 is disposed, and the shaft rod 23 is rotatably held via the slide bearing 24.

The plating apparatus 1 is disposed in the plating tank 6 pooling the plating solution 61 wherein the plating jig 2 is completely immersed (FIG. 3). Subsequently, the motor 50 of the driving mechanism 5 is driven, the rotary movement of the motor 50 is transmitted to the plating jig 2 via the gears 51, 52, 53 and 25, and the plating jig 2 is rotated by the rotary movement.

According to the plating jig 2 of the embodiment of the present invention, the wafers 3 are rotated about the rotational axis horizontally disposed when the wafers 3 are plated. Therefore, if the density of hydrogen generated from the plating solution 61 pooled in the plating tank 6 differs in depth, the rotation of the wafers 3 prevents the plating applied to the wafers 3 from becoming inhomogeneous.

If the temperature of the plating solution 61 depends on depth and varies in the depth direction, the rotation of the wafers 3 prevents the plating applied to the wafers 3 from becoming inhomogeneous due to the difference in velocity of forming a plated film.

Structure of the plating jig 2 allows a plurality of the wafers 3 to be supported. Accordingly, a number of wafers 3 can be plated at a time.

The notches 20*a* of the plating jig 2 are formed in a V-shaped cross-section, the notches 20*a* can easily hold the wafers 3 and minimize the contact area between the wafers 3 and the supporting rods 3, whereby performing the processing of plating over a wide area.

The preferred embodiment of the present invention described above is not limited, but can be modified without departing from the spirit and scope of the present invention.

For example, the embodiment of the present invention exemplifies the plating of the circular silicon wafer which is an object to be plated. However, a shape and a material with respect to the object to be plated are not limited.

The length of the supporting rod, the number of notches formed on the supporting rod, and the interval between the notches can be changed as needed.

The notches of the supporting rod are formed along the circumferential direction of the supporting rod in the embodiment. However, the notches may as well be formed only on the wafers to be supported.

The method of fixing the supporting rods to the end plates is not limited to screwing by the bolts.

What is claimed is:

1. A plating jig for holding an object to be plated, being immersed in plating solution, and being rotated about a rotational axis horizontally disposed, the plating jig comprising:

a plurality of supporting rods disposed in parallel with the rotational axis and having a plurality of notches formed at a predetermined interval along the rotational axis;

a pair of end plates for fixing both ends of the plurality of supporting rods; and a supporting member for rotatably supporting the end plates in the plating solution at two locations along the rotational axis horizontally disposed, each location being on an opposite side of a respective end plate from the supporting rods; wherein the supporting rods are disposed so as to hold and support the object to be plated therebetween.

2. The plating jig according to claim 1, wherein the notches are formed in a V-shaped cross section.

3. The plating jig according to claim 2, wherein the plurality of supporting rods are disposed at regular intervals.

4. The plating jig according to claim 1, wherein the plurality of supporting rods are disposed at regular intervals.

5. The plating jig according to claim 1, wherein four supporting rods are disposed to hold and support the object to be plated.

6. The plating jig according to claim 1, wherein each of the end plates has a shaft rod projectingly disposed on the rotational axis of the plating jig, and each shaft rod is fixed by a slide bearing rotatably supported by the supporting member.

7. The plating jig according to claim 6, wherein the supporting member has a guiding groove supporting the end plates slidably and removably.

8. The plating jig according to claim 7, wherein the guiding groove is formed with a slope so that a bottom part is lower than an opening part.

9. The plating jig according to claim 1, further comprising a driving mechanism having a plurality of gears configured to transmit a driving force generated by a motor to the end plates, wherein the motor is located apart from the plating solution while the object to be plated is immersed in the plating solution.

10. The plating jig according to claim 9, wherein the gears are constituted with chemical resistant material.

* * * * *